US006095909A

United States Patent [19]

Chenu

[11] Patent Number: 6,095,909

[45] Date of Patent: Aug. 1, 2000

[54] ABRASIVE BELT MACHINE TOOL FOR MACHINING CYLINDRICAL BEARING SURFACES ON SHAFTS

[75] Inventor: Gabriel Chenu, Evry Cedex, France

[73] Assignee: Societe des Procedes Et Machines Speciales S.P.M.S., France

[21] Appl. No.: 09/090,938

[22] Filed: Jun. 5, 1998

[30] Foreign Application Priority Data

Jun. 6, 1997 [FR] France ..... 97 07043

[51] Int. Cl.[7] ..... B24B 21/00

[52] U.S. Cl. ..... 451/302; 451/49; 451/303

[58] Field of Search ..... 451/49, 302, 303

[56] References Cited

U.S. PATENT DOCUMENTS

| | | | |
|---|---|---|---|
| 4,140,456 | 2/1979 | Sato | 451/302 X |
| 5,683,291 | 11/1997 | Humpert et al. | 451/49 X |
| 5,755,615 | 5/1998 | Kiriyama | 451/302 X |
| 5,775,974 | 7/1998 | Hulsebus | 451/49 X |
| 5,775,978 | 7/1998 | Brocksieper et al. | 451/302 X |

FOREIGN PATENT DOCUMENTS

8815174 U 2/1990 Germany .

*Primary Examiner*—Timothy V. Eley
*Attorney, Agent, or Firm*—Smith, Gambrell & Russell, LLP

[57] ABSTRACT

Abrasive belt machine tool for machining cylindrical bearing surface on shafts, in particular journals on camshafts or journals and/or crank pins on crankshafts, comprising for machining each bearing surface two opposed jaws 5 mounted on two arms 1 and each having first and second concave application surfaces 6*a*, 6*b* having different diameter in at least two different positions. The abrasive belt 9 passes in front of the concave surfaces 6*a* and 6*b* of the two jaws 5. The support 2 of the arms is mobile between at least two positions such that in one of said positions the first concave surface 6*a* can apply the abrasive belt 9 to a bearing surface 8*a* having a corresponding diameter on a first shaft and in the other of said positions the concave surfaces 6*b* can apply the abrasive belt 9 to a bearing surface having a corresponding diameter on a second shaft.

3 Claims, 6 Drawing Sheets

ABRASIVE BELT MACHINE TOOL FOR MACHINING CYLINDRICAL BEARING SURFACES ON SHAFTS

The present invention concerns an abrasive belt machine tool for machining cylindrical bearing surfaces on shafts, in particular journals on camshafts or journals and/or crank pins on crankshafts.

Prior art machines of this type comprise two arms pivoting in a plane on a common support for machining each bearing surface of the shaft which is rotated about its axis during machining. Two opposed jaws are mounted on said arms and each has a cylindrical segment shape concave application surface having a diameter corresponding to the diameter of the bearing surface to be machined. Guide means are provided for passing the abrasive belt in front of the application surfaces of the two jaws. Means for maneuvering the arms apply the abrasive belt to the bearing surface to be machined via the concave surfaces of the opposed jaws.

Prior art machines of the above type are set up to machine bearing surfaces on identical shafts. In the field of automobile engines it is increasingly frequent for the same engine architecture to be available in a number of models or types distinguished by different power ratings, for example. In this case it is common for the crankshafts of the various engine models or types to have the same length, the same number of journals and the same number of crank pins but to have different diameters of the journals and/or crank pins. At present using abrasive belts to machine such crankshafts requires either a machine dedicated to the crankshafts of each engine type or model or stopping the machine and changing the jaws to change from a crankshaft for one type or model to another. The same problem arises in machining journals of camshafts.

It would be desirable to be able to change from abrasive belt machining of the bearing surfaces of camshafts or crankshafts for one type or model to those for another type or model on the same machine tool without needing to stop the latter to change the jaws to match the concave abrasive belt application surfaces to the various diameters of the bearing surfaces to be machined.

The present invention is precisely directed to a machine tool achieving this result in a simple manner subject to minimal additional cost.

On the abrasive belt machine tool in accordance with the invention at least first and second concave application surfaces having different diameters are mounted in opposition in at least two different positions on the arms so that the abrasive belt passes in front of the concave surfaces of the two jaws. The support is mobile between at least two positions such that in one of said positions the first concave surfaces having a first diameter of the jaws can apply the abrasive belt to a bearing surface having a corresponding diameter on a first shaft and in the other of said positions the second concave surfaces having a second diameter can apply the abrasive belt to a bearing surface having a corresponding diameter on a second shaft.

Accordingly, simply by changing the position of the support for the arms carrying the jaws, and with no other operation, it is possible to change instantaneously from machining bearing surfaces of a shaft of a first type or model to machining corresponding bearing surfaces having a different diameter of a shaft of another type or model.

In the context of the invention, the jaws mounted on the arms can be either multiple jaws each having at least two concave application surfaces with different diameters or single jaws in which case at least two single jaws having concave surfaces with different diameters are mounted at different positions on each arm.

One illustrative and non-limiting embodiment of the machine in accordance with the invention will be described in more detail hereinafter with reference to the accompanying drawings; in the drawings.

Figure 1:
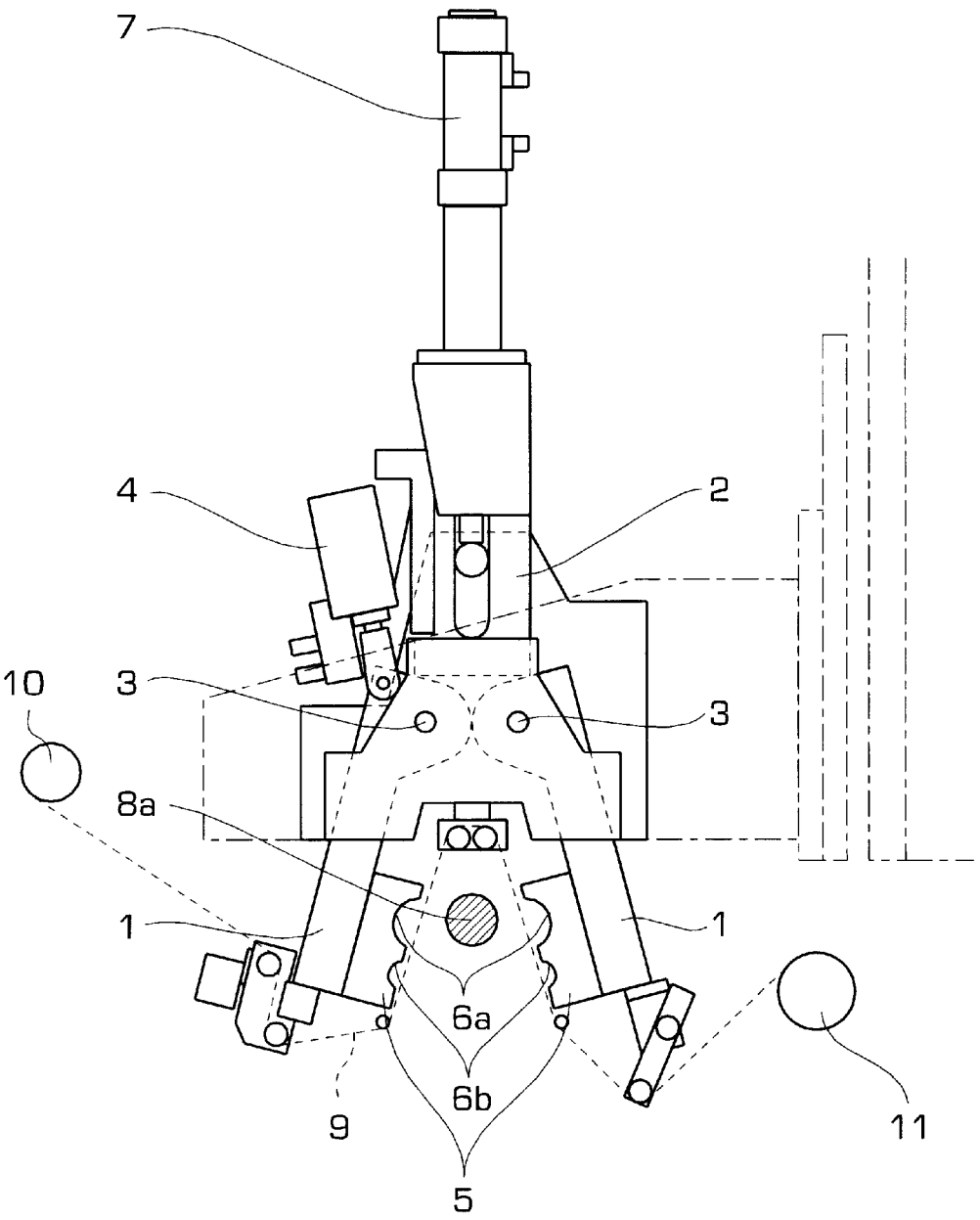
FIG. 1 is a general view of a machining unit of the machine tool in accordance with the invention showing the support, the two pivoting arms each carrying a double jaw and the means of manoeuvring the two arms, the jaws being open before closing them onto a shaft bearing surface having a first diameter.

The abrasive belt machine tool shown in the drawings constitutes, for example, a machine for superfinishing cylindrical bearing surfaces on shafts, in particular journals on camshafts or crank pins and/or journals on crankshafts. For machining each bearing surface of the shaft it comprises a pair of opposed arms 1 mounted on a common support 2 so that the two arms, coupled by gears, can be pivoted about pivots 3 by manoeuvring means 4 consisting of a hydraulic cylinder. The inside face at the free lower end of each arm 1, facing towards the opposite arm, carries a double jaw 5 comprising two cylindrical segment shape concave surfaces 6*a*, 6*b* the parallel axes of which are spaced from each other along the length of the arms 1.

The support 2 common to the two arms 1 can be moved vertically by a hydraulic cylinder 7 the travel of which is defined so as to bring the application surfaces 6*a* or 6*b* of the two jaws 5 selectively to either side of the bearing surface 8 to be machined of the shaft, which can be held between points and rotated about its axis in the manner well known in the field of abrasive machining of shaft bearing surfaces.

Figure 2:
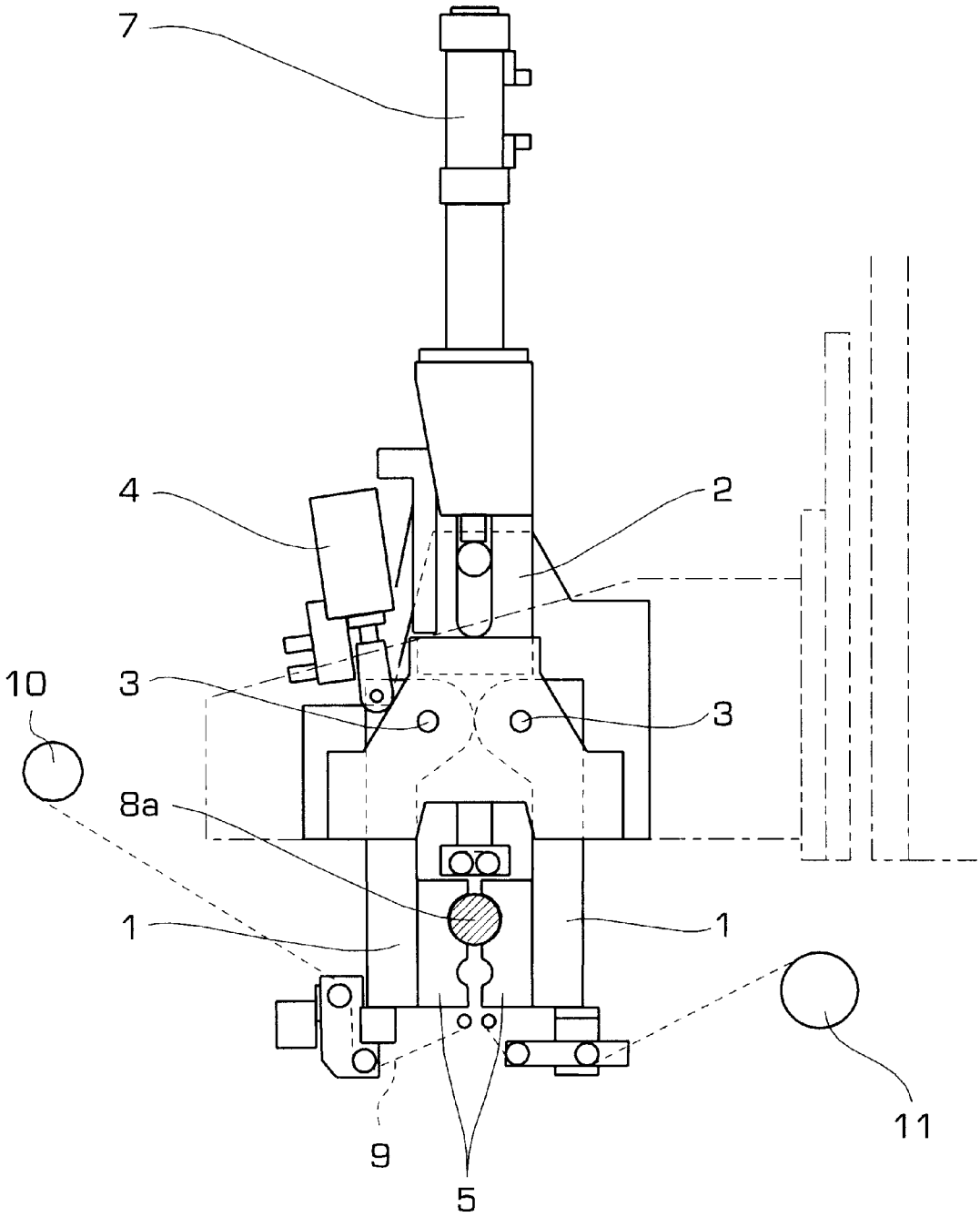
FIG. 2 shows the assembly from FIG. 1 after closing the jaws onto the bearing surface to be machined.
Figure 3:
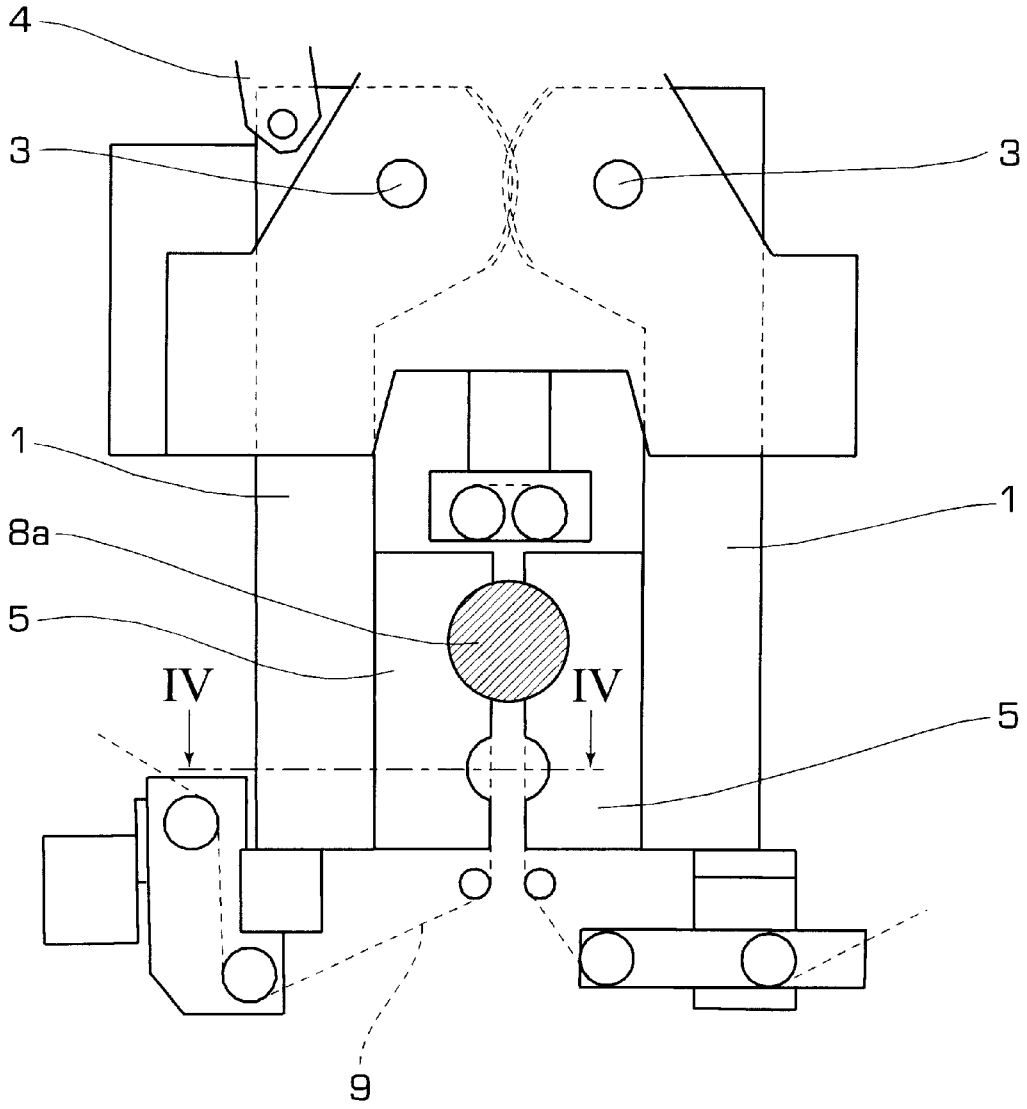
FIG. 3 represents the same situation as FIG. 2 to a larger scale.
Figure 5:
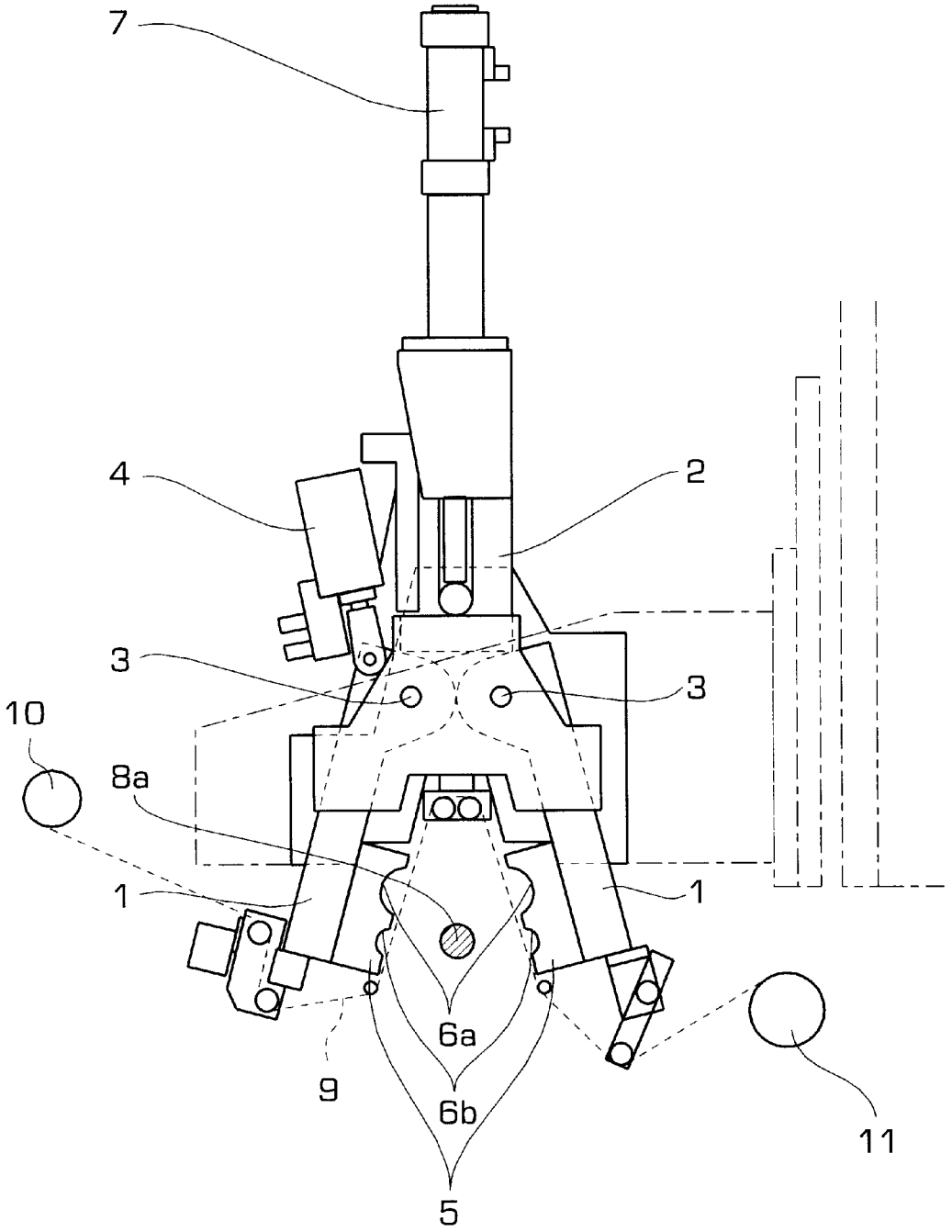
FIG. 5 is a view corresponding to that of FIG. 1 before the jaws are closed onto a second bearing surface.
Figure 6:
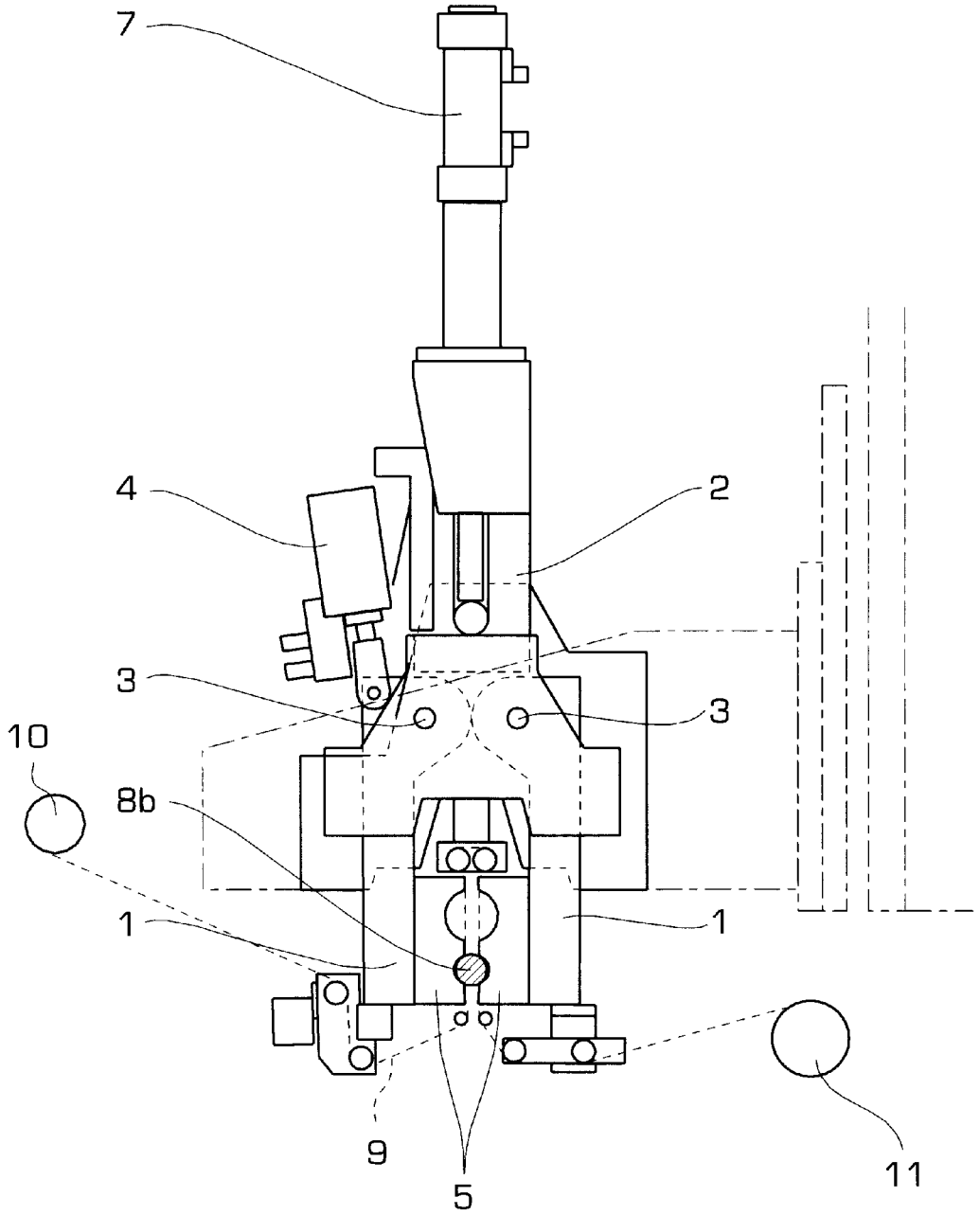
FIG. 6 shows the assembly from FIG. 4 after closing the jaws.
Figure 7:
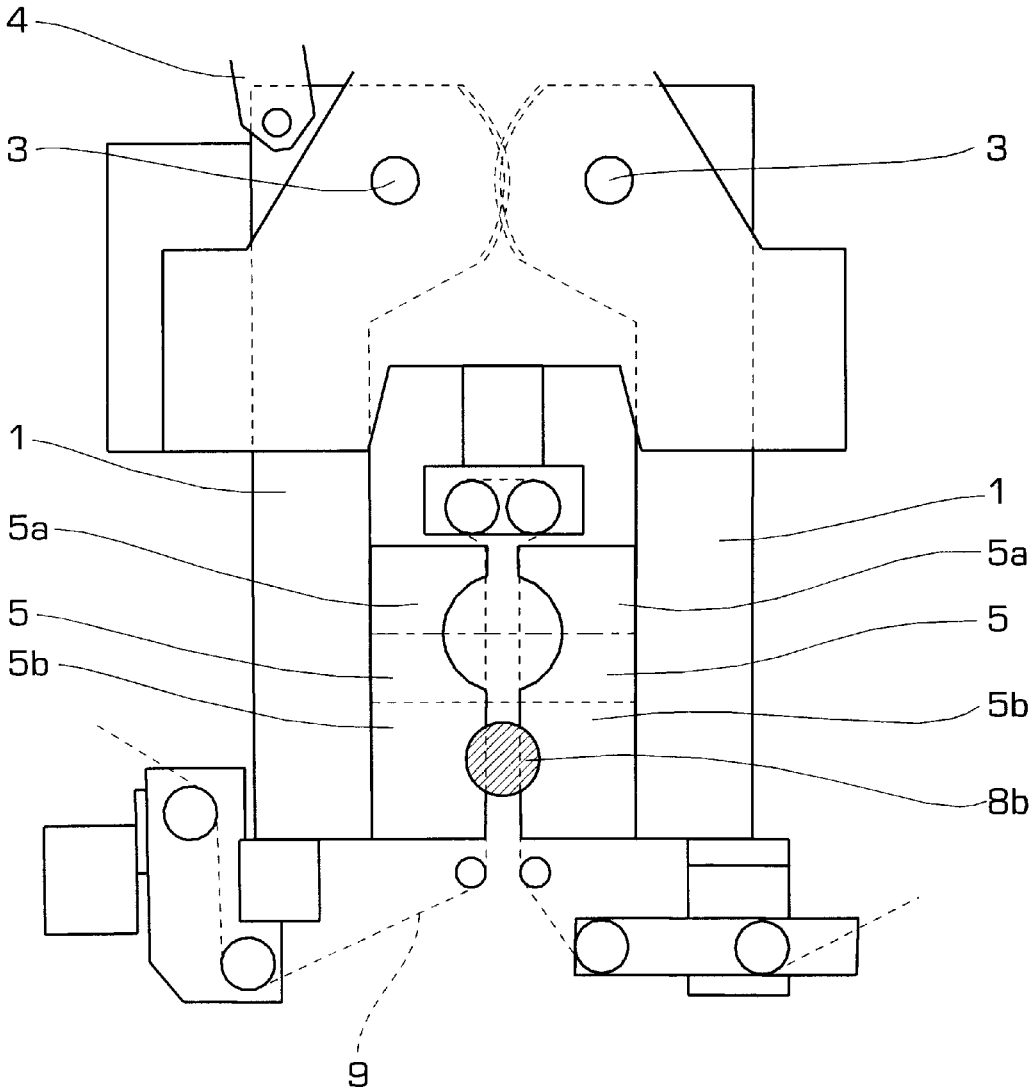
FIG. 7 shows the same situation as FIG. 6 to a larger scale.

The concave surfaces 6*a* of the two jaws 5 have a radius of curvature corresponding to the radius of curvature of a first bearing surface 8*a* and shown in FIGS. 1 to 3 and the concave surfaces 6*b* of the jaws 5 having a radius of curvature corresponding to the radius of a second bearing surface 8*b* shown in FIGS. 5 through 7, the two radii being different. In the example shown the radius of curvature of the surfaces 6*a* (and therefore the radius of the bearing surface 8*a*) is greater than the radius of curvature of the surfaces 6*b* (and therefore the radius of the bearing surface 8*b*).

Guide means pass an abrasive belt 9 in front of the two concave surfaces 6*a*, 6*b* of each jaw 5. Between two successive machining cycles the belt is advanced, in a manner that is known in itself, from a reserve spool 10 onto a take-up spool 11.

In FIGS. 1 to 3 the support 2, the arms 1 and the jaws 5 are in a bottom position in which the concave surfaces 6*a* of the jaws 5 are on either side of a bearing surface 8*a* to be machined, the radius of which bearing surface corresponds to the radius of curvature of the surfaces 6*a*. Accordingly, when the jaws 5 are clamped up by the cylinder 4, the concave surfaces 6*a* of the jaws 5 apply the abrasive belt 9 to the bearing surface 8*a*.

In FIGS. 5 through 7, however, the jaws 5 are in a top position in which the concave surfaces 6*b* of the jaws 5 are on either side of a bearing surface 8*b* the radius of which corresponds to the radius of curvature of the surfaces 6*b* so that when the jaws 5 are clamped up the concave surfaces 6*b* of the jaws 5 apply the abrasive belt 9 to the bearing surface 8*b*.

It is therefore possible, on the same abrasive belt machine tool, to change instantaneously from machining a bearing surface 8*a* having a first diameter of a first shaft to machining a bearing surface 8*b* having a second diameter of a second shaft, and vice versa, without any operation other than changing the position of the jaws 5, which is achieved by actuating the cylinder 7.

Figure 4:
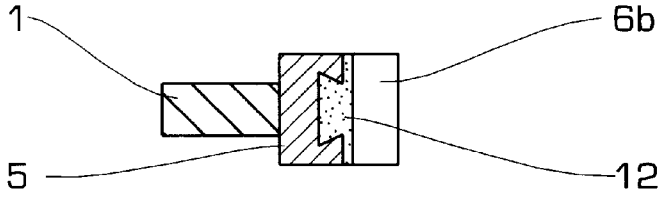
FIG. 4 is a section taken along the line IV—IV in FIG. 3.

FIG. 4 shows that the concave surface 6*b* (like the concave surface 6*a*) of each jaw 5 is not defined directly by the metal jaw 5 itself but by a lining 12 of a more flexible material, for example polyurethane, which is attached to the jaw 5 to achieve a more regular distribution of the pressure with which the abrasive belt 9 is applied to the bearing surface to be machined.

Note also that in the context of the invention the number of concave abrasive belt application surfaces with different radii carried by each arm 1 can be greater than two, in which case the cylinder 7 can move the jaws 5 into more than two different positions, enabling more than two bearing surfaces with different diameters to be machined on the same machine.

Finally, FIG. 7 shows in dashed line that each jaw 5, rather than being a multiple jaw, in this instance a double jaw having two concave application surfaces with different radii, could comprise two single jaws 5*a*, 5*b* each having one application surface, the two jaws 5*a* and 5*b* of each arm 1 having concave surfaces with different radii and being mounted in different positions on the arm 1.

What is claimed is:

1. An abrasive belt machine tool for machining cylindrical bearing surfaces on shafts, in particular journals on camshafts or journals and/or crank pins on crankshafts, comprising the following elements for machining each bearing surface while the shaft is rotated about an axis:

two arms mounted to pivot in a plane on a common support, two opposed jaws mounted on said arms, each of said opposed jaws having at least first and second concave application surfaces of first and second diameters which are different, said first and second concave application surfaces on one jaw being mounted in opposition to said first and second concave application surfaces on the jaw which is opposed thereto, said abrasive belt passing in front of the concave surfaces of the two jaws, said arms being supported for movement between at least two positions such that in one of said positions the opposed first concave application surfaces apply the abrasive belt to a bearing surface having one diameter on a first shaft, and in the other of said positions the concave surfaces apply the abrasive belt to a bearing surface having another diameter on a second shaft.

2. A machine according to claim 1 wherein each of said opposed jaws is a multiple jaw member which has at least two concave application surfaces of different diameters.

3. A machine according to claim 1 wherein each of said opposed jaws includes at least two single jaw members with different diameters, mounted in different positions on a said arm.

* * * * *